US009385474B2

(12) United States Patent
Kamei

(10) Patent No.: US 9,385,474 B2
(45) Date of Patent: Jul. 5, 2016

(54) CONTACT AND CONNECTOR INCLUDING CONTACT

(71) Applicant: JAPAN AVIATION ELECTRONICS INDUSTRY, LIMITED, Shibuyaku, Tokyo (JP)

(72) Inventor: Yuji Kamei, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 14/694,893

(22) Filed: Apr. 23, 2015

(65) Prior Publication Data

US 2016/0013586 A1 Jan. 14, 2016

(30) Foreign Application Priority Data

Jul. 8, 2014 (JP) ..... 2014-140492

(51) Int. Cl.

| | |
|---|---|
| ***H01R 4/48*** | (2006.01) |
| ***H01R 13/631*** | (2006.01) |
| ***H01R 13/05*** | (2006.01) |
| ***H01R 13/18*** | (2006.01) |
| ***H01R 13/502*** | (2006.01) |
| ***H01R 13/516*** | (2006.01) |
| *H01R 13/187* | (2006.01) |
| *H01R 13/17* | (2006.01) |

(52) U.S. Cl.

CPC ..... *H01R 13/631* (2013.01); *H01R 13/055* (2013.01); *H01R 13/18* (2013.01); *H01R 13/502* (2013.01); *H01R 13/516* (2013.01); *H01R 13/17* (2013.01); *H01R 13/187* (2013.01)

(58) Field of Classification Search

CPC ..... H01R 13/111

USPC ..... 439/839, 842, 843, 846, 847, 849, 859, 439/744, 745, 891

See application file for complete search history.

(56) References Cited

U.S. PATENT DOCUMENTS

| | | | | |
|---|---|---|---|---|
| 3,139,318 A * | 6/1964 | Binder | H01R 13/115 | 439/849 |
| 4,012,102 A * | 3/1977 | Cherney | H01R 43/16 | 439/404 |
| 4,764,133 A * | 8/1988 | Kaneko | H01R 13/04 | 439/845 |
| 5,281,178 A * | 1/1994 | Biscorner | H01R 13/052 | 439/845 |

FOREIGN PATENT DOCUMENTS

JP 08250178 A 9/1996

* cited by examiner

*Primary Examiner* — Phuongchi T Nguyen
(74) *Attorney, Agent, or Firm* — Holtz, Holtz & Volek PC

(57) ABSTRACT

A contact increased in contact reliability by accommodating misalignment from a mating contact. A female-side contact includes a contact body including a contact portion that is brought into contact with a mating contact portion of a male-side contact, and a supporting member formed separate from the contact body, for receiving therein the mating contact portion and movably supporting the contact portion. The supporting member includes a supporting member body for receiving therein the mating contact portion and the contact portion, and first and second spring portions provided on the supporting member body, for bringing the mating contact portion inserted in the supporting member body and the contact portion into contact with each other. The contact portion includes a contact portion body having a flat plate shape and contact point portions protruding from the contact portion body into the inside of the supporting member body.

23 Claims, 20 Drawing Sheets

CONTACT AND CONNECTOR INCLUDING CONTACT

BACKGROUND OF THE INVENTION

1. Field of the Invention

This invention relates to a contact and a connector including the contact.

2. Description of the Related Art

As shown in FIGS. 18 to 20, conventionally, there has been proposed a female terminal fitting 910 formed by integrally assembling a terminal body 911 which is formed by bending a conductive metal plate and includes a terminal fitting portion 912 and a wire connection portion 913, and an elastic contact body 925 which is a separate component from the terminal body 911 and is formed by bending a conductive metal plate (see Japanese Laid-Open Patent Publication (Kokai) No. H08-250178). The terminal fitting portion 912 has a box shape having a horizontally long rectangular cross-section, and has an insertion opening 916 formed in a front end thereof for allowing a male terminal fitting, not shown, to be inserted. A ceiling plate 918 of the terminal fitting portion 912 is formed with a pair of tab contact portions 918A which protrude downward. The pair of tab contact portions 918A each have a semi-cylindrical shape, and extend in a front-rear direction (see FIGS. 18 and 19). A bottom plate 914 is formed with an excessive bending-preventing section 923 curving upward. The excessive bending-preventing section 923 is a part for preventing an elastic bending section 928, described hereinafter, from being excessively bent.

The wire connection portion 913 includes an insulation barrel 913A and a wire barrel 913B. The insulation barrel 913A is connected to a resin coated part of a wire, not shown, and the wire barrel 913B is connected to the core of the wire.

The elastic contact body 925 is formed by bending a plate having a rectangular shape. A front end portion of the elastic contact body 925 is an engaging portion 926 forming a flat plate shape. A rear end portion of the elastic contact body 925 is formed with a holding portion 927 by bending the rear end portion into a U-shape, as viewed from the side. The holding portion 927 is formed by an upper plate portion 927A, a rising portion 927B, and a lower plate portion 927C. The holding portion 927 has a dimension in the front-rear direction which is set to be slightly smaller than a spacing between a front stopper 920F and a rear stopper 920R of the terminal fitting portion 912. The upper plate portion 927A is arranged between the front stopper 920F and the rear stopper 920R of the terminal fitting portion 912 in a manner immovable in the front-rear direction. Further, the dimension of the holding portion 927 in a height direction is set to be equal to a spacing between the bottom plate 914 and a protection plate 919 of the terminal fitting portion 912. The upper plate portion 927A is in contact with the protection plate 919 and the lower plate portion 927C is in contact with the bottom plate 914 (see FIG. 18), whereby the elastic contact body 925 is held within the terminal fitting portion 912 in a manner immovable in a vertical direction.

The elastic bending section 928 is formed by bending a portion of the elastic contact body 925 between the engaging portion 926 and the holding portion 927 such that the portion is caused to curve upward. A tab contact portion 928A protruding upward is formed on the top of the elastic bending portion 928.

Right and left end portions of the engaging portion 926 of the elastic contact body 925 extend forward under pressing portions 922 of the terminal fitting portion 912 in a manner movable in the front-rear direction.

When a tab (not shown) of the male terminal fitting is inserted between the tab contact portions 918A of the terminal fitting portion 912 and the tab contact portion 928A of the elastic contact body 925, the elastic bending portion 928 is bent, whereby the tab of the male terminal fitting is sandwiched between the tab contact portions 918A of the terminal fitting portion 912 and the tab contact portion 928A of the elastic contact body 925. A constant contact force is generated between the tab of the male terminal fitting and the tab contact portions 918A of the terminal fitting portion 912, and between the tab of the male terminal fitting and the tab contact portion 928A of the elastic contact body 925, respectively, by action of a returning force of the elastic bending portion 928. The tab of the male terminal fitting is brought into line contact with the tab contact portions 918A, and is brought into point contact with the tab contact portion 928A.

Usually, the elastic contact body 925 is made of stainless steel, and the terminal body 911 is made of copper or copper alloy. Therefore, electric current mainly flows via a contact portion between the tab of the male terminal fitting and the tab contact portions 918A of the terminal fitting portion 912.

If the female terminal fitting 910 or the male terminal fitting is low in shaping accuracy, or if an electric wire connected to the wire connection portion 913 of the female terminal fitting 910 is pulled, misalignment may occur between the female terminal fitting 910 and the male terminal fitting which are in a connected state.

For example, if the electric wire connected to the wire connection portion 913 of the female terminal fitting 910 is pulled, causing inclination of the tab contact portions 918A of the female terminal fitting 910 with respect to the tab of the male terminal fitting, a parallel positional relationship between the tab of the male terminal fitting and the tab contact portions 918A of the female terminal fitting 910 is lost, which reduces a contact area between the tab of the male terminal fitting and the tab contact portions 918A of the female terminal fitting 910. When the contact area between the tab of the male terminal fitting and the tab contact portions 918A of the female terminal fitting 910 is reduced, the contact resistance is largely changed, so that there is a fear of reduction of the contact reliability.

SUMMARY OF THE INVENTION

The present invention has been made in view of these circumstances, and an object thereof is to increase the contact reliability of a contact by accommodating misalignment of the contact from a mating contact.

To attain the above object, in a first aspect of the present invention, there is provided a contact comprising a contact body including a contact portion that is brought into contact with a mating contact portion of a mating contact, and a supporting member that is a component separate from the contact body, and not only receives therein the mating contact portion, but also supports the contact portion in a movable manner, wherein the supporting member includes a supporting member body that receives therein the mating contact portion and the contact portion, and a spring portion that is provided on the supporting member body, for bringing the mating contact portion inserted into the supporting member body and the contact portion into contact with each other, and wherein the contact portion includes a contact portion body having a flat plate shape, and a contact point portion protruding from the contact portion body into an inside of the supporting member body.

Preferably, the contact point portion has a cylindrical surface, and the central axis of the cylindrical surface is orthogonal to a direction of the central axis of the supporting member and a bending direction of the spring portion.

Preferably, the contact point portion has a spherical surface, and a straight line connecting a center and an apex of the spherical surface is parallel to the bending direction.

More preferably, the supporting member body has a square tube shape, the supporting member body includes an upper wall and a lower wall which are opposed to each other, and the spring portion is provided on at least one of the upper wall and the lower wall.

Further preferably, the supporting member body includes a pair of side walls which are at right angles to the upper wall and the lower wall, respectively, and are opposed to each other, the pair of side walls each have a hole formed therethrough, and the contact portion includes a plurality of protrusions which are continuous with the contact portion body, and are inserted into the holes and supported by the pair of side walls in a movable manner.

More preferably, the supporting member body has a U-shape in cross-section, the supporting member body includes a wall opposed to the contact portion body, and the spring portion is provided on the wall.

Further preferably, the supporting member body includes a pair of side walls which are at right angles to the wall, respectively, and are opposed to each other, the pair of side walls each have a hole formed therethrough, and the contact portion includes a plurality of protrusions which are continuous with the contact portion body and are inserted into the holes and supported by the pair of side walls in a movable manner.

Preferably, the supporting member includes a stopper portion for restricting movement of the contact portion in a direction parallel to the direction of the central axis of the supporting member.

Preferably, the contact body is different in thickness from the supporting member, and the contact body is larger in thickness than the supporting member.

Preferably, the contact body includes a connection portion that is continuous with the contact portion and is connected to an object to be connected.

More preferably, the object to be connected is a cable.

To attain the above object, in a second aspect of the present invention, there is provided a connector comprising the contact described above, and a housing that accommodates the contact, and holds the supporting member.

Preferably, the housing includes a housing body that is inserted into a mounting hole formed in a casing, and a flange portion that is provided on an outer peripheral surface of the housing body, and has bolt insertion holes for use in fixing the housing body to the casing.

According to the present invention, it is possible to increase the contact reliability of the contact by accommodating the misalignment thereof from the mating contact.

The above and other objects, features and advantages of the present invention will become more apparent from the following detailed description taken in conjunction with the accompanying drawings.

DETAILED DESCRIPTION OF THE PREFERRED EMBODIMENT

Figure 1:
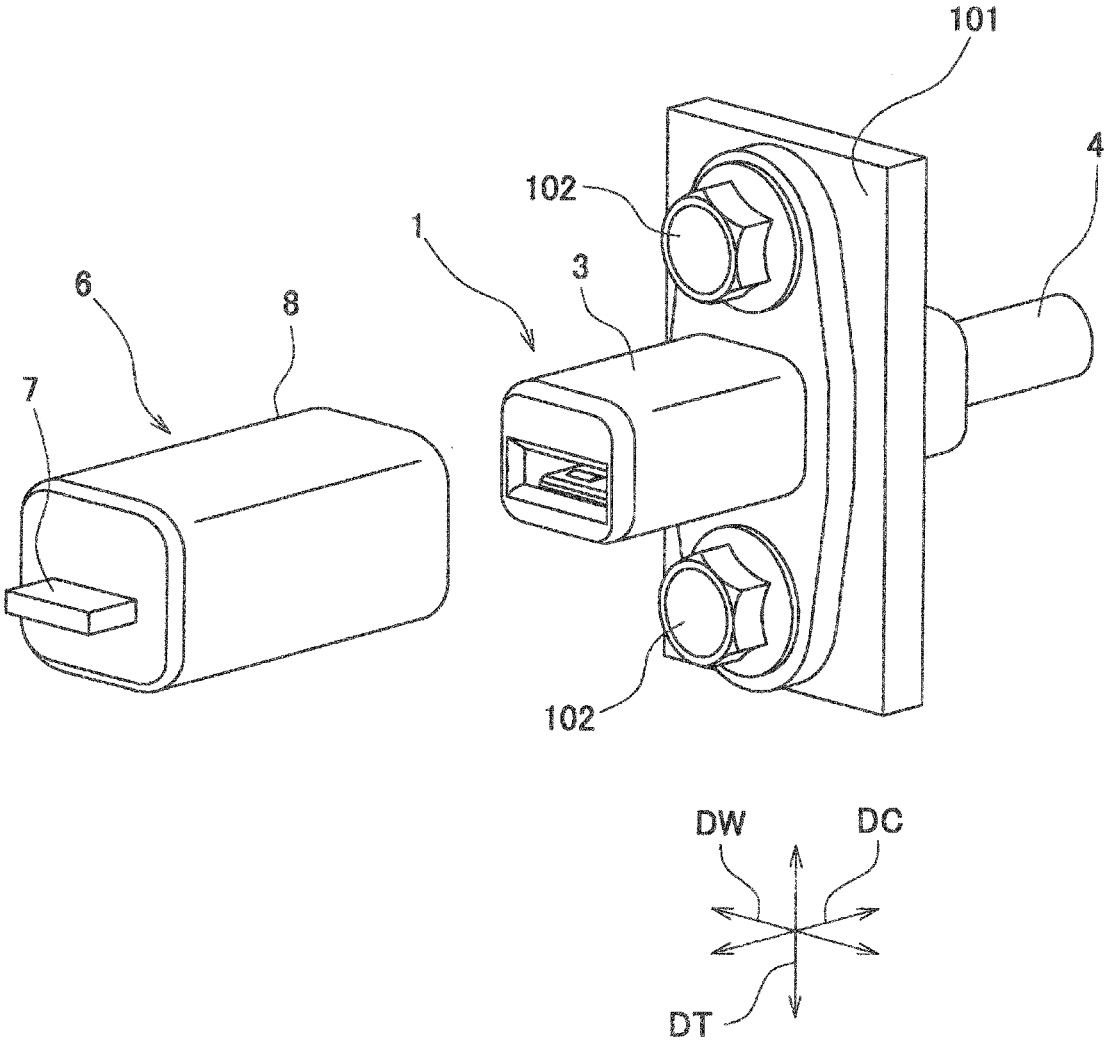
FIG. 1 is a perspective view of a female connector according to an embodiment of the present invention and a male connector in a state in which the male connector is about to be fitted to the female connector.

The present invention will now be described in detail with reference to the drawings showing a preferred embodiment thereof.

A description will be given of a female connector according to the embodiment of the present invention with reference to FIGS. 1 to 17.

As shown in FIGS. 1 to 4, the female connector (connector), denoted by reference numeral 1, is attached to a casing 101 of an electronic device, and is connected to a male connector 6.

The female connector 1 is comprised of a female-side contact (contact) 2 and a female-side housing (housing) 3.

Figure 5:
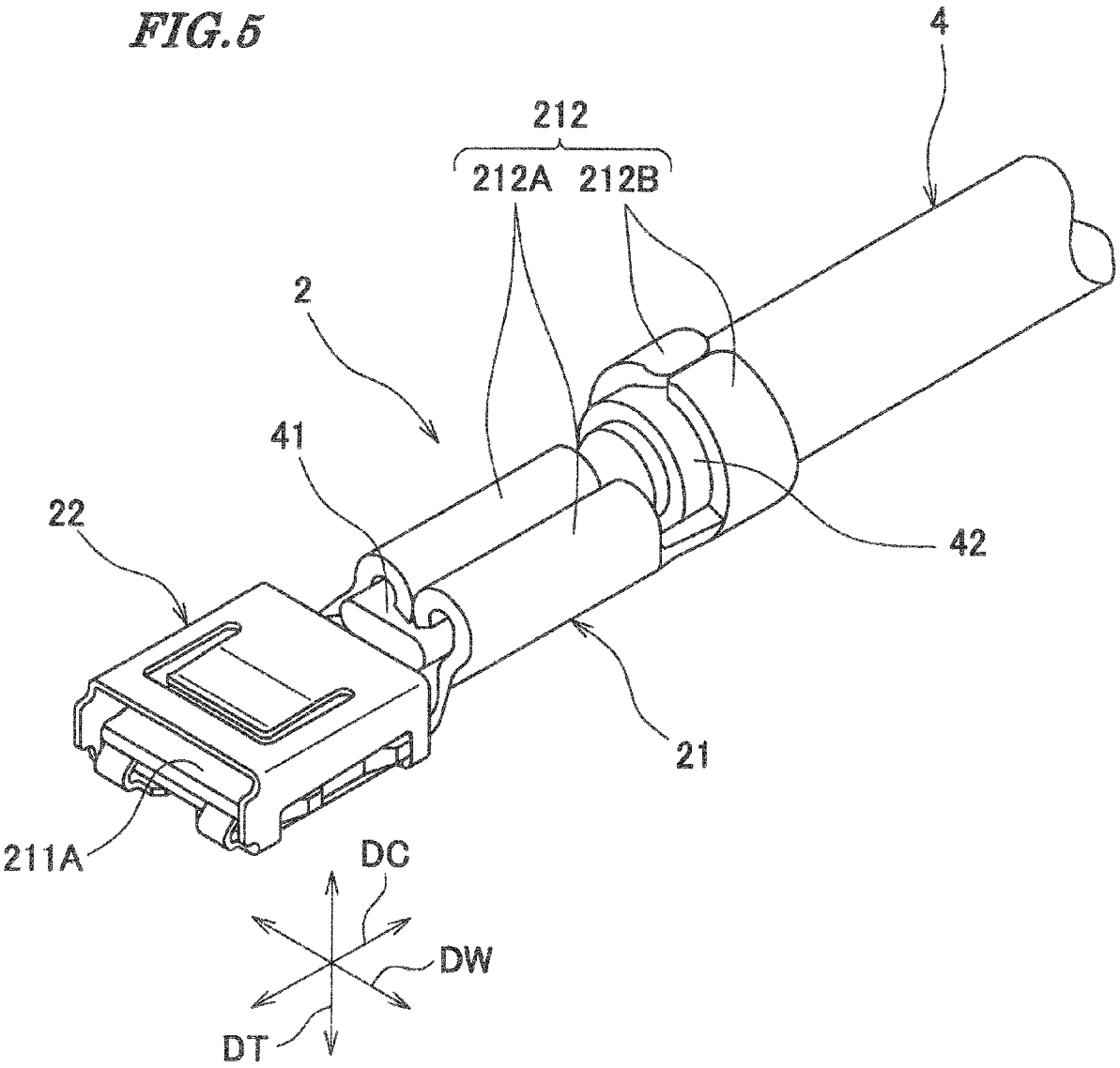
FIG. 5 is a perspective view of a female-side contact of the female connector appearing in FIG. 1.
Figure 6:
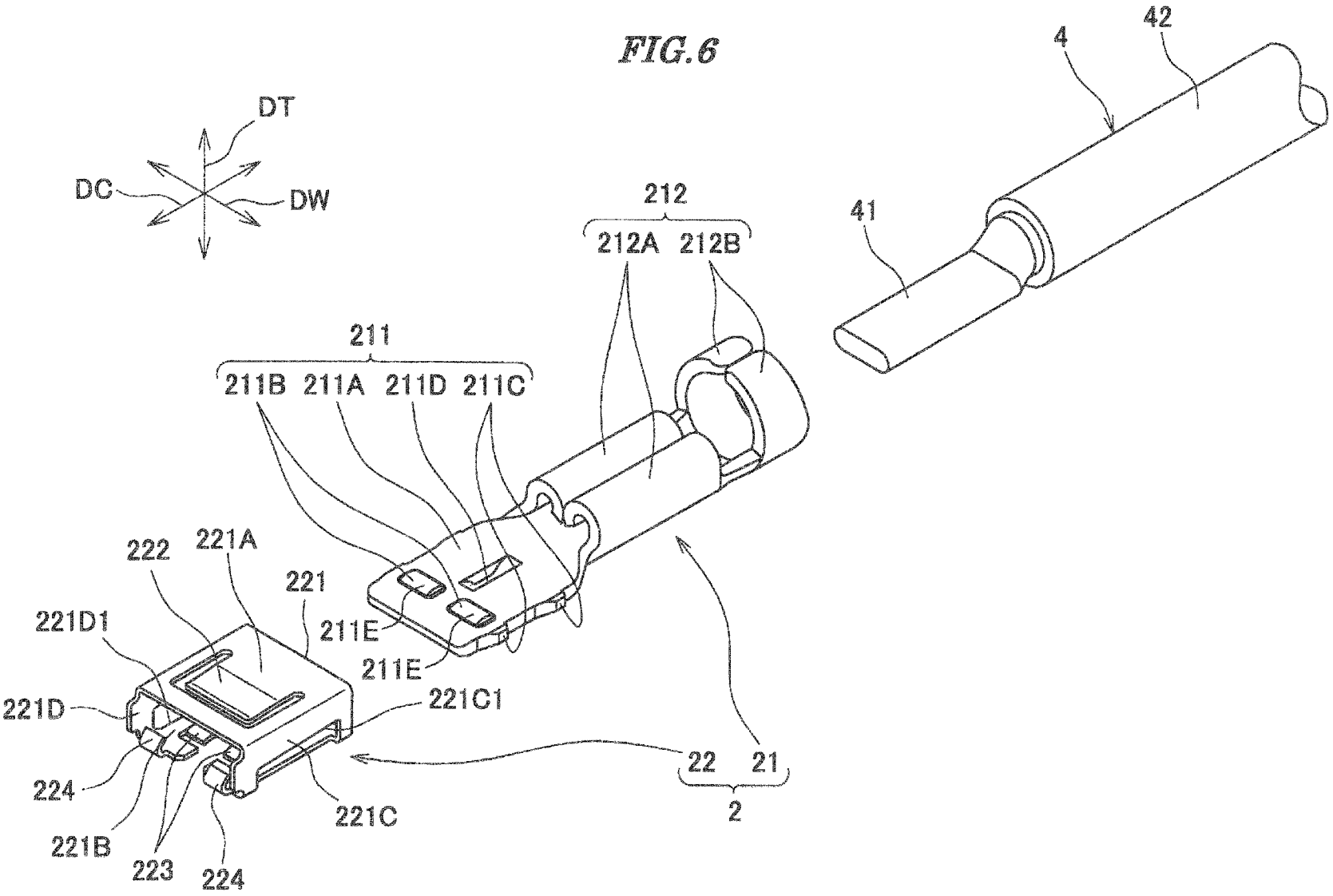
FIG. 6 is an exploded perspective view of the female-side contact shown in FIG. 5.
Figure 7:
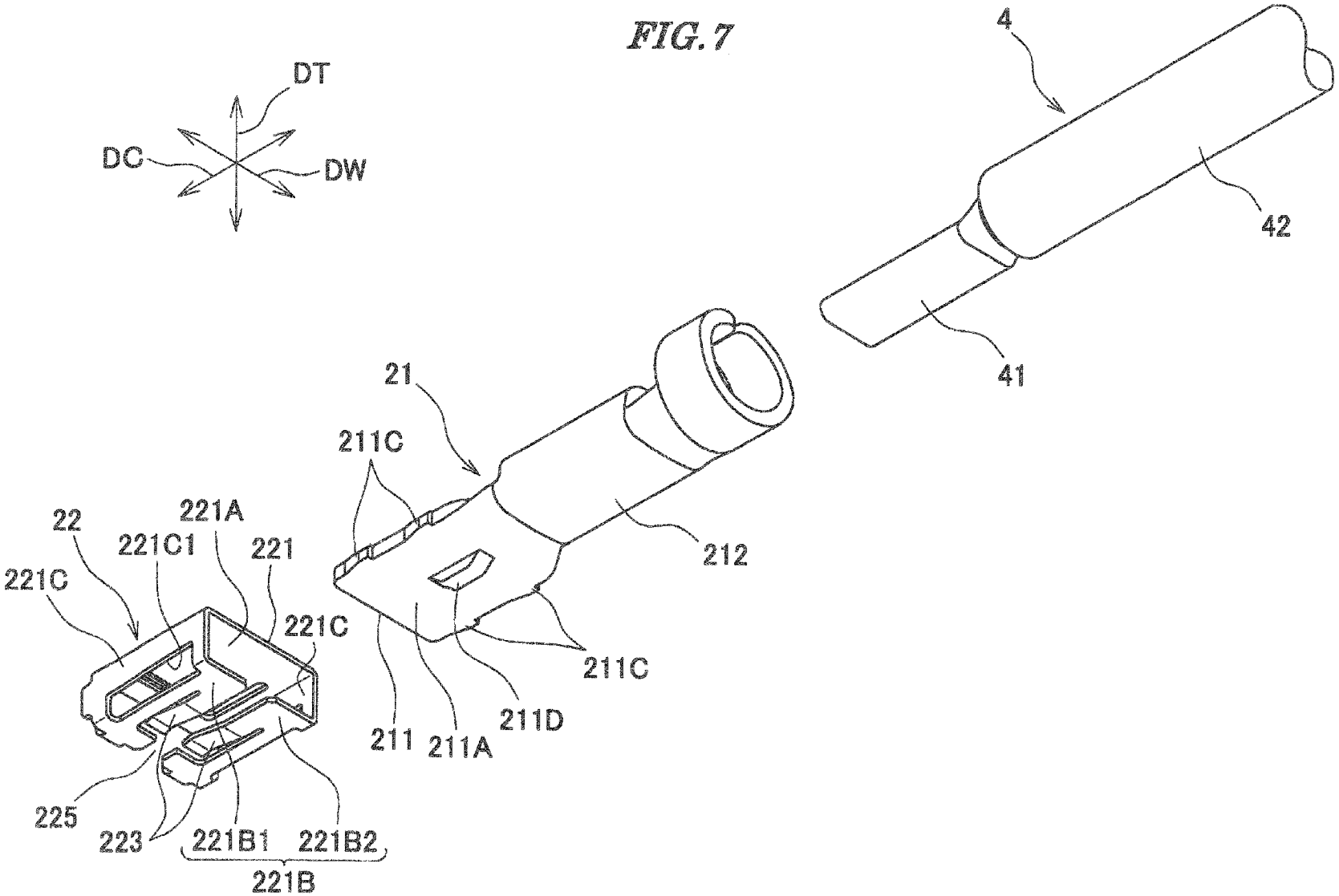
FIG. 7 is an exploded perspective view of the female-side contact shown in FIG. 6, as viewed from below.

As shown in FIGS. 5 to 7, the female-side contact 2 is comprised of a contact body 21 and a supporting member 22.

The contact body 21 includes a contact portion 211 which is brought into contact with a contact portion (mating contact portion) 71 of a male-side contact (mating contact) 7, having a flat plate shape, of the male connector 6 (see FIG. 10), and a connection portion 212 which is continuous with the contact portion 211 and is connected to a cable (object to be connected) 4. As a material for the contact body 21, there may be used, for example, copper, copper alloy, or the like.

The contact portion 211 includes a contact portion body 211A having a flat plate shape, contact point portions 211B which protrude from an upper surface of the contact portion body 211A, protrusions 211C which protrude from opposite side surfaces of the contact portion body 211A, and a protruding portion 211D which protrudes from a lower surface of the contact portion body 211A. In the female-side contact 2, a thick metal plate can be used as the contact body 21, and hence the female-side contact 2 is suitable for a high-current contact. Further, even if the contact portion body 211A of the contact body 21 is large in thickness, the contact portion body 211A can be easily processed because of the flat plate shape thereof.

The two contact point portions 211B each have a cylindrical surface 211E. The central axis (not shown) of the cylindrical surface 211E is orthogonal to a direction DC of the central axis of the supporting member 22, and a bending direction of a first spring portion 222 (spring portion) and second spring portions (spring portion) 223, described hereinafter (hereinafter referred to as "the spring portion-bending direction DT"). A state referred to by the term "orthogonal" mentioned above includes a state of being not strictly at right angles to each other.

The protrusions 211C are provided in pairs on the opposite side surfaces of the contact portion body 211A, respectively. Each protrusion 211C is wedge-shaped. The two protrusions 211C provided on one side surface of the contact portion body 211A enter a hole 221C1 of a side wall 221C, and one of the two protrusions 211C on the rear side (toward the cable 4) is hooked on a rear end portion of the side wall 221C. The two protrusions 211C provided on the other side surface of the contact portion body 211A enter a hole 221D1 of a side wall 221D, and one of the two protrusions 211C on the rear side is hooked on a rear end portion of the side wall 221D.

The connection portion 212 includes a pair of crimp portions 212A and a pair of crimp portions 212B. The pair of crimp portions 212A are crimped to thereby hold a core wire 41 of the cable 4 in a manner embracing the core wire 41. The pair of crimp portions 212B are crimped to thereby hold a sheath 42 of the cable 4 in a manner embracing the sheath 42. As the core wire 41 of the cable 4 appearing in FIG. 6 and other figures, there may be used a core wire which has been shaped in advance as illustrated in the figures, or the core wire 41 may be a core wire circular in cross-section, discrete wires, or any other suitable wire or wires.

The supporting member 22 is a separate component from the contact body 21. The supporting member 22 receives therein the contact portion 71 of the male-side contact 7 of the male connector 6, and supports the contact portion 211 of the contact body 21 in a movable manner. Note that the phrase "to support the contact portion 211 in a movable manner" is to be interpreted as to support the contact portion 211 in a manner movable in the spring portion-bending direction DT and support the contact portion 211 in a manner rotatable about a pivotal axis (not shown) parallel to a direction orthogonal to the direction DC of the central axis of the supporting member 22 and the spring portion-bending direction DT (hereinafter referred to as the "width direction DW"). The pivotal axis is located in the vicinity of the central axis of the cylindrical surfaces 211E.

The supporting member 22 includes a supporting member body 221, the first spring portion 222, the second spring portions 223, and stoppers 224. As a material for the supporting member 22, there may be used, for example, stainless steel. The supporting member 22 is formed by pressing a plate of stainless steel. The supporting member 22 is smaller in thickness than the contact body 21, and hence is excellent in spring property and processability. Note that as a material for the supporting member 22, there may be used copper, copper alloy, or the like in place of stainless steel.

The supporting member body 221 receives therein the contact portion 71 of the male connector 6 and the contact portion 211 of the contact body 21. The supporting member body 221 has a square tube shape, and includes an upper wall 221A, a lower wall 221B, the side wall 221C, and the side wall 221D.

Figure 8:
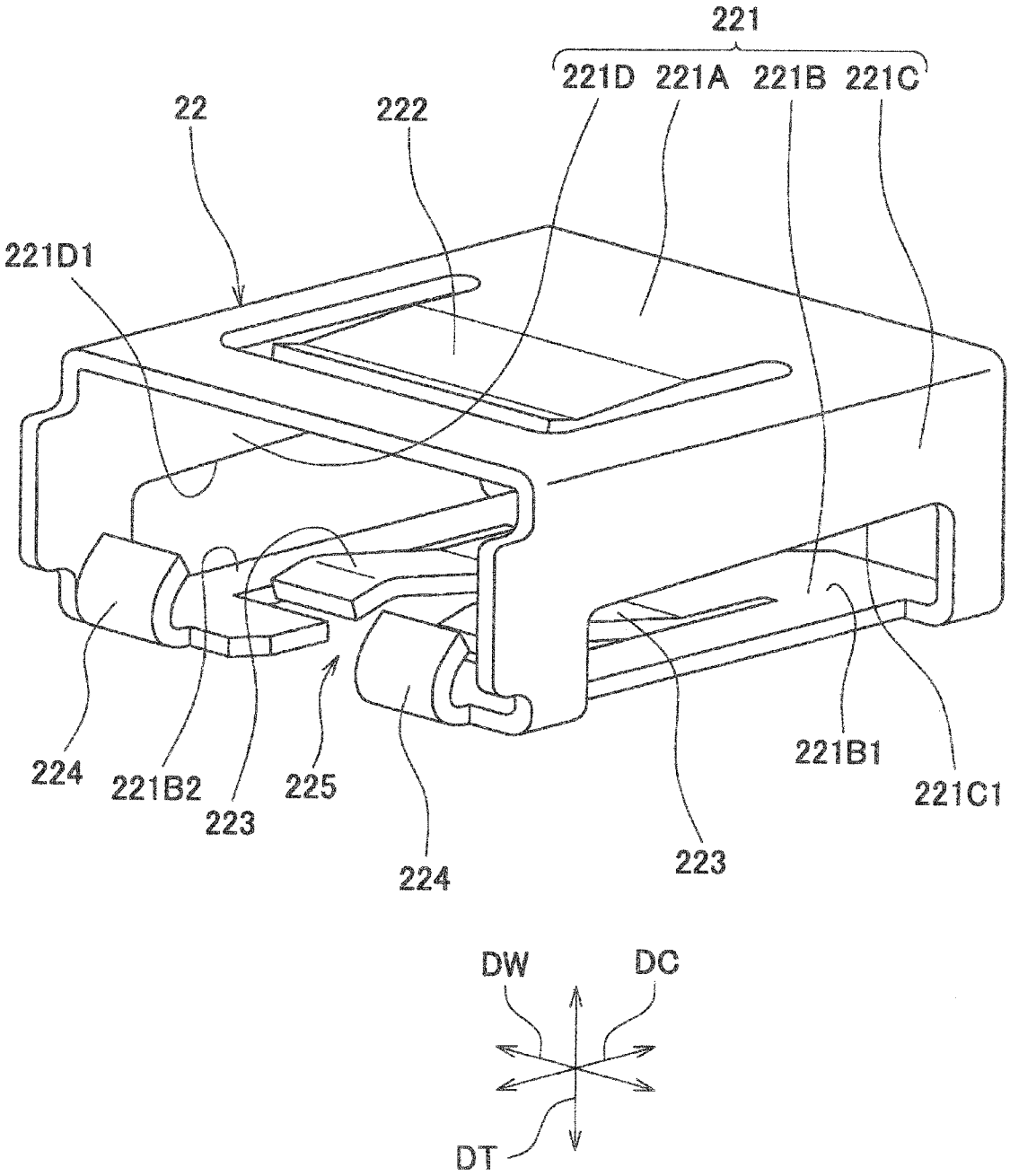
FIG. 8 is a perspective view of a supporting member appearing in FIG. 5.
Figure 9:
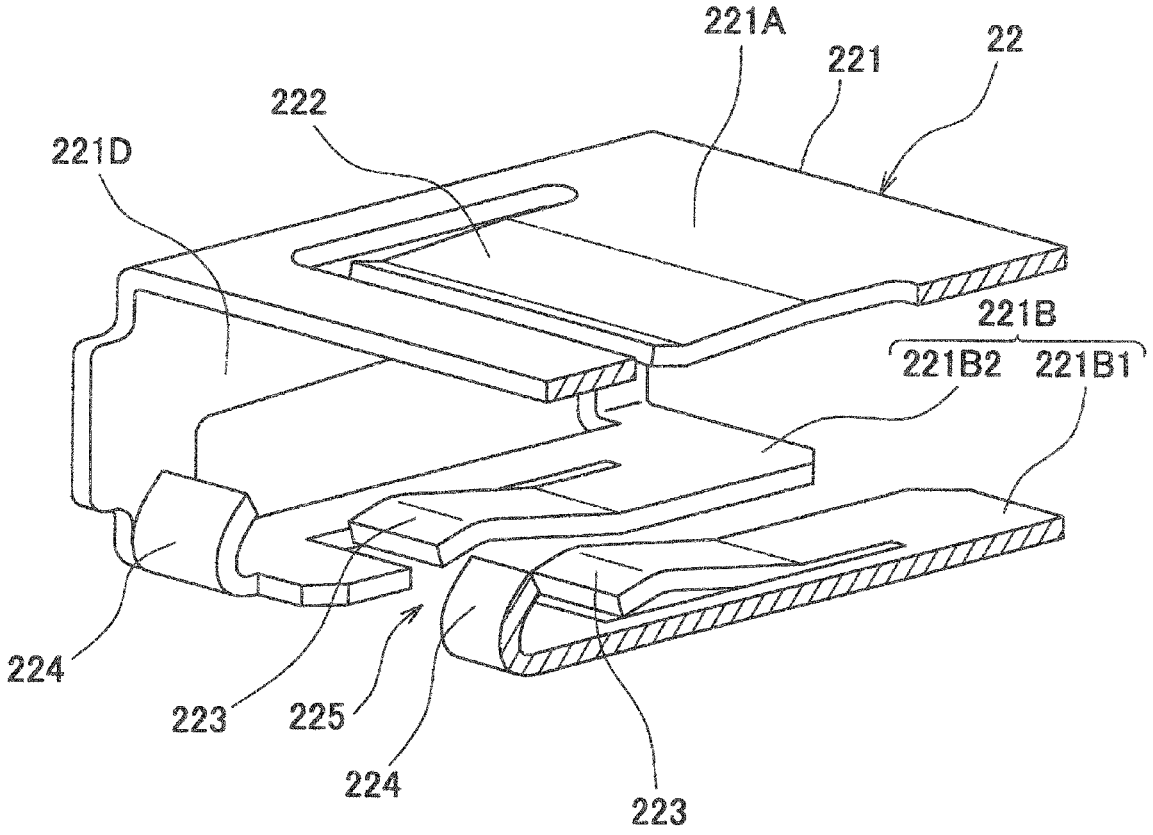
FIG. 9 is a partially cutaway perspective view of the supporting member shown in FIG. 8.
Figure 10:
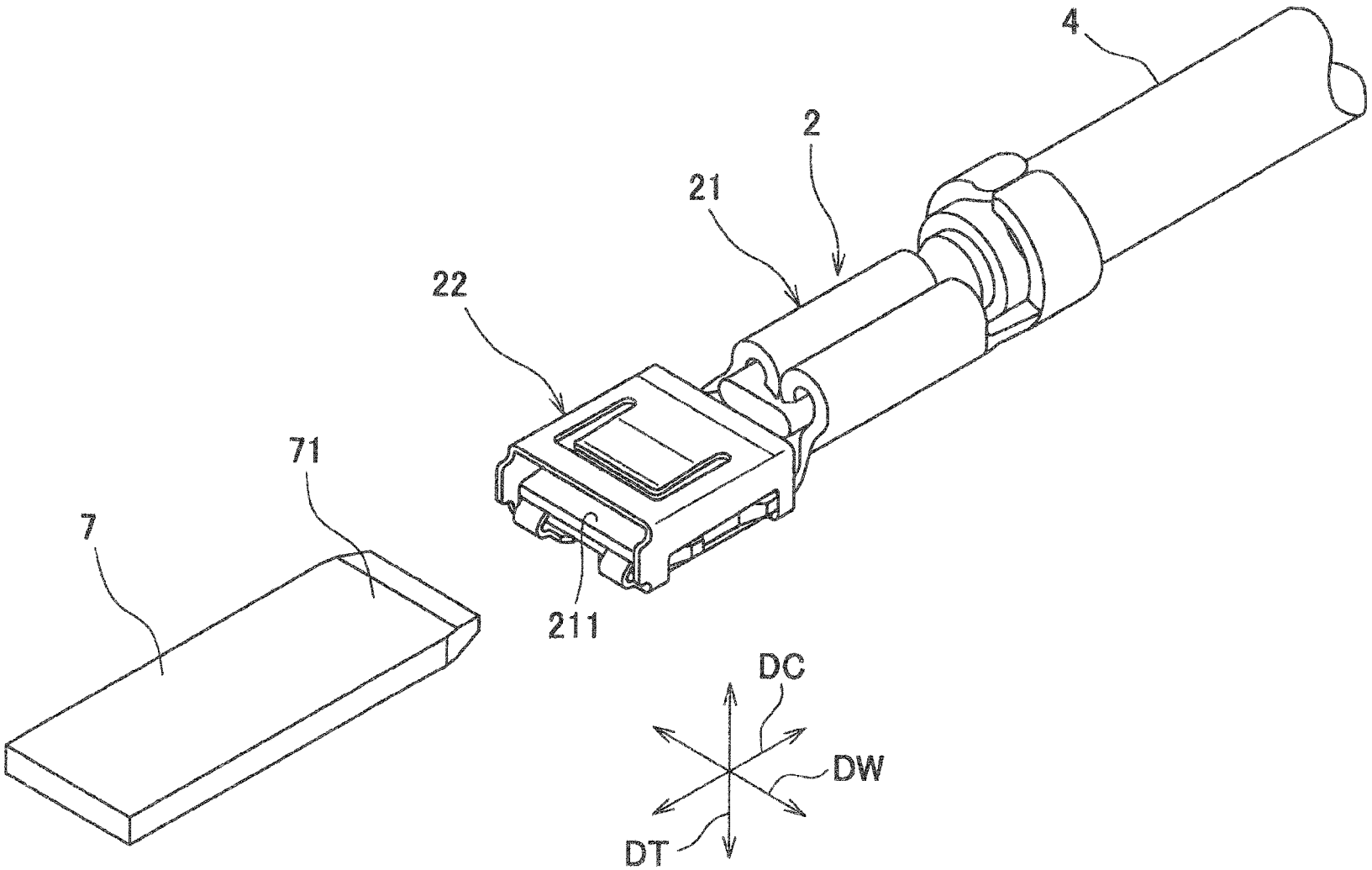
FIG. 10 is a perspective view of the female-side contact shown in FIG. 5 and a male-side contact in a state in which the male-side contact is about to be inserted into the female-side contract.

As shown in FIGS. 8 and 9, the upper wall 221A and the lower wall 221B are opposed to each other in the spring portion-bending direction DT. The side wall 221C and the side wall 221D are at right angles to the upper wall 221A and the lower wall 221B, respectively. The side wall 221C and the side wall 221D are opposed to each other in the width direction DW. The lower wall 221B is separated into two parts in the width direction DW. A lower wall part 221B1 as one part of the lower wall 221B is continuous with the side wall 221C, and a lower wall part 221B2 as the other part of the same is continuous with the side wall 221D. A gap 225 is formed between the one lower wall part 221B1 and the other lower wall part 221B2. The protruding portion 211D of the contact portion 211 inserted into the supporting member body 221 of the supporting member 22 enters the gap 225. The protruding portion 211D functions as a mark for preventing a worker from inserting the contact portion 211 into the supporting member 22 in a state inverted upside down (see FIG. 7).

The hole 221C1, which has a rectangular shape, is formed in a lower part of the side wall 221C, and the hole 221D1, which has a rectangular shape, is formed in a lower part of side wall 221D. The hole 221C1 and the hole 221D1 are the same in shape and size. The respective upper edges of the holes 221C1 and 221D1 are inclined such that they become lower as they extend forward (see FIGS. 8 and 12). The protrusions 211C of the contact portion 211 are inserted in the holes 221C1 and 221D1, respectively, whereby the contact portion 211 is supported by the side wall 221C and the side wall 221D in a movable manner.

The first spring portion 222 is provided on the upper wall 221A. One of the two second spring portions 223 is provided on the one lower surface part 221B1, and the other of the same is provided on the other lower surface part 221B2. The first spring portion 222 and the second spring portions 223 bring the contact portion 71 of the male-side contact 7 inserted into the supporting member body 221 and the contact portion 211 of the contact body 21 into contact with each other.

One of the two stoppers 224 extends from the front end of the one lower surface part 221B1, and is bent into a U-shape, and the other of the two stoppers 224 extends from the front end of the other lower surface part 221B2, and is bent into a U-shape. Each stopper 224 restricts the movement of the contact portion 211 in the supporting member maim body 221 in the direction DC of the central axis of the supporting member 22 so as to prevent the same from protruding from the front end of the supporting member body 221. Further, each stopper 224 also functions as a guide for guiding the male-side contact 7 of the male connector 6 into the supporting member body 221. The position of the front ends of the stoppers 224 and the position of the front ends of the side wall 221C and the side wall 221D coincide with each other in the direction DC of the central axis of the supporting member 22.

Therefore, when the supporting member 22 is accommodated in the female-side housing 3, even if the stoppers 224 are brought into contact with the female-side housing 3, the stoppers 224 are prevented from being deformed. Note that the position of the front ends of the stoppers 224 may be slightly shifted backward from the position of the front ends of the side wall 221C and the side wall 221D.

Figure 4:
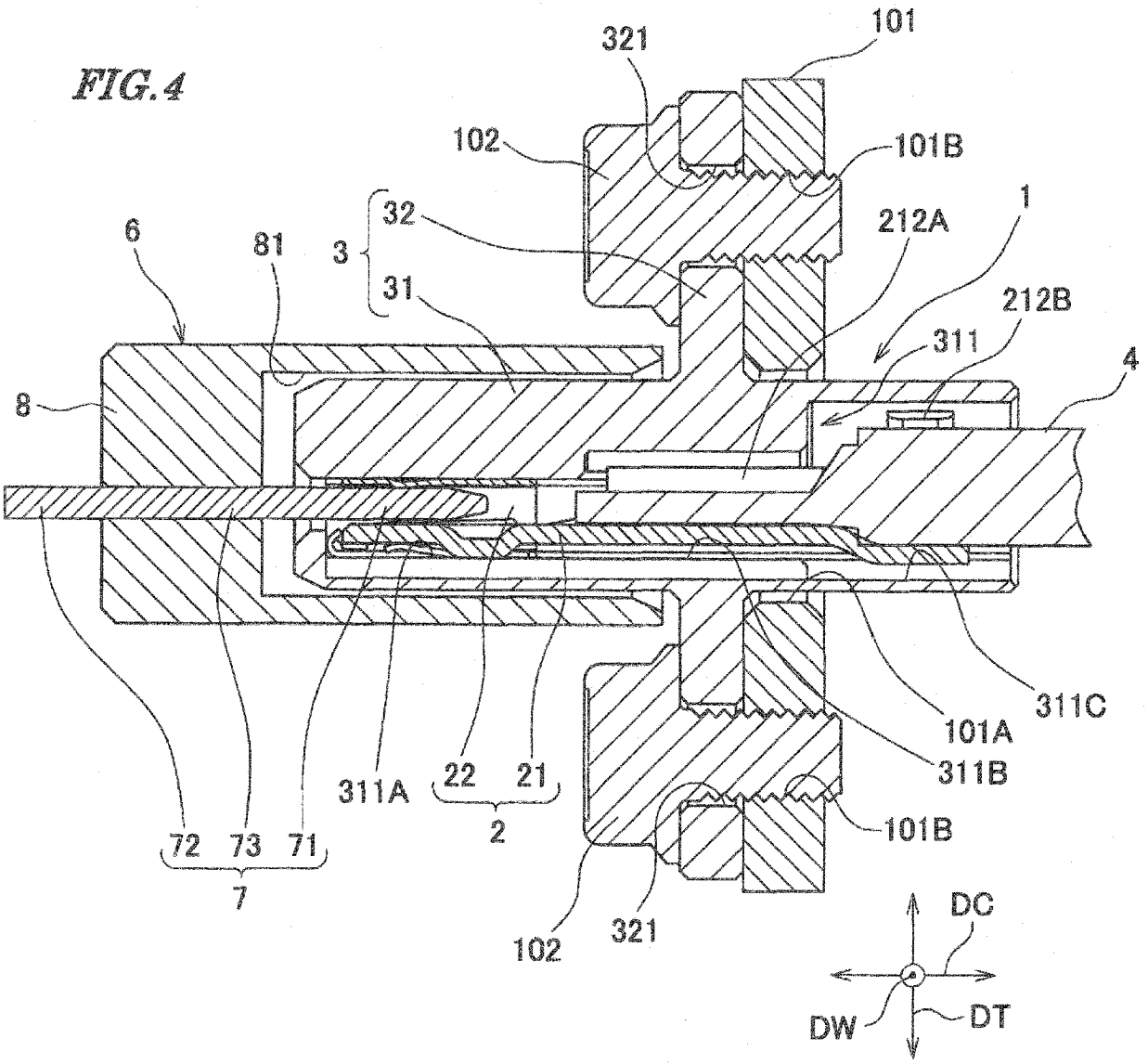
FIG. 4 is a cross-sectional view of the female connector and the male connector shown in FIG. 3.

As shown in FIG. 4, the female-side housing 3 includes a housing body 31 having a square tube shape and a flange portion 32 having a flat plate shape. As a material for the female-side housing 3, there may be used, for example, insulating resin.

The housing body 31 is inserted in a mounting hole 101A formed in the casing 101. The housing body 31 has a contact accommodating chamber 311 for accommodating the contact body 21. The contact accommodating chamber 311 has a first accommodating section 311A, a second accommodating section 311B, and a third accommodating section 311C. The first accommodating section 311A accommodates the contact portion 211 of the contact body 21 and the supporting member 22. The supporting member 22 is fixed in the first accommodating section 311A by a lance, not shown, provided in the first accommodating section 311A. The second accommodating section 311B accommodates the crimp portions 212A of the contact body 21 in a vertically movable manner. The third accommodating section 311C accommodates the crimp portions 212B of the contact body 21 in a vertically movable manner.

The flange portion 32 is formed on an outer peripheral surface of the housing body 31 and has bolt insertion holes 321 formed therein for allowing insertion of bolts 102 used for fixing the housing body 31 to the casing 101. The bolts 102 inserted through the bolt insertion holes 321 are screwed into female screws 101B of the casing 101.

Next, a description will be given of how to assemble the female connector 1.

First, the contact portion 211 of the contact body 21 is inserted into the supporting member body 221 of the supporting member 22. At this time, the protrusions 211C of the contact portion 211 push the side wall 221C and the side wall 221D of the supporting member 22 outward from the inside to thereby increase the spacing between the side wall 221C and the side wall 221D, and accordingly, the contact portion 211 is slid into the supporting member body 221. When the two protrusions 211C provided on the one side surface of the contact portion body 211A enter the hole 221C1 of the side wall 221C, and the two protrusions 211C provided on the other side surface of the contact portion body 211A enter the hole 221D1 of the side wall 221D, the spacing between the side wall 221C and the side wall 221D return to the original state. The rear and surface of each protrusion 211C is at right angles to the direction DC of the central axis of the supporting member 22, and hence the contact portion 211 is prevented by the rear end portions of the side wall 221C and the side wall 221D from moving rearward of the supporting member 22. However, the protrusions 211C can move in the spring portion-bending direction DT within the holes 221C1 and 221D1.

Next, the core wire 41 of the cable 4 is placed on the pair of crimp portions 212A, and the sheath 42 of the cable 4 is placed on the pair of crimp portions 212B. Note that FIG. 6 is an exploded perspective view of the female-side contact 2 shown in FIG. 5, and hence the crimp portions 212A and 212B are illustrated in a state crimped into an arc shape in cross-section, but portions of the crimp portions 212A and 212B outward of respective central portions corresponding to a width of the core wire 41 are linearly erected before assembling the female-side contact 2. Then, the crimp portions 212A and 212B are crimped, respectively, to thereby connect the cable 4 to the connection portion 212.

Finally, the female-side contact 2 is accommodated in the contact accommodating chamber 311 of the female-side housing 3. At this time, the supporting member 22 is hooked on the lance of the female-side housing 3, and hence the supporting member 22 is held in the first accommodating section 311A of the contact accommodating chamber 311 of the female-side housing 3.

Thus, through the above-described process, assembly of the female connector 1 is completed.

Next, a description will be given of the male connector 6 which is a mating connector of the female connector 1.

As shown in FIGS. 1 to 4, the male connector 6 is comprised of the male-side contact 7 and a housing 8. The male-side contact 7 includes the contact portion 71, a connection portion 72, and a held portion 73. The contact portion 71 having a flat plate shape protrudes into a receiving portion 81 of the housing 8, and is brought into contact with the contact portion 211 of the female connector 1 in the receiving portion 81. The connection portion 72 protrudes from a rear end surface of the housing 8, and is connected to a cable (not shown). Crimp portions of the connection portion 72, which are crimped to a core wire and a sheath of the cable, are omitted in the drawings. The held portion 73 is a portion held by the housing 8, and connects the contact portion 71 and the connection portion 72.

The housing 8 has a square tube shape, and includes the receiving portion 81. The receiving portion 81 receives part of the housing body 31 of the female connector 1 forward of the flange portion 32.

Figure 2:
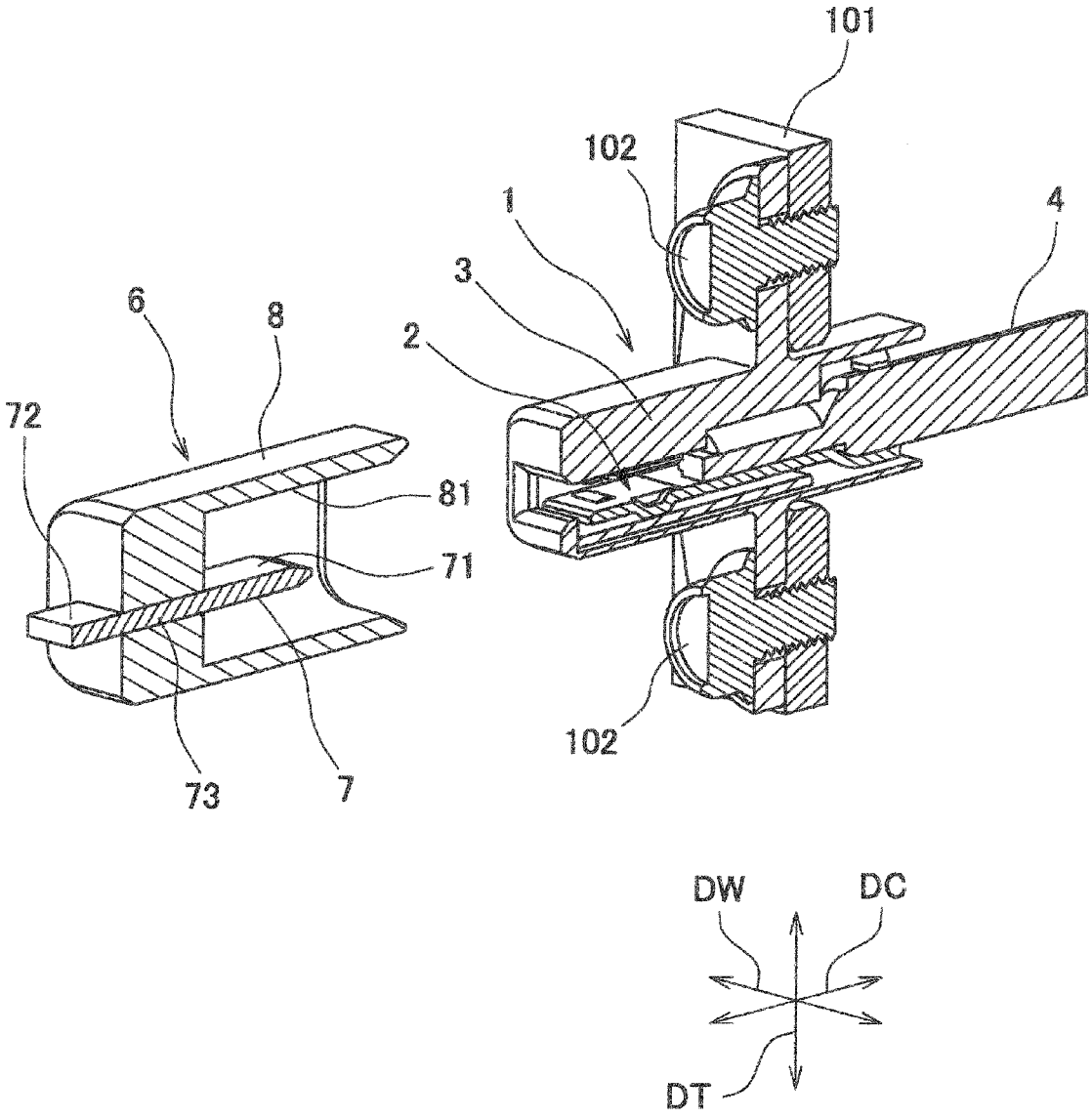
FIG. 2 is a perspective cross-sectional view of the female connector and the male connector shown in FIG. 1.
Figure 3:
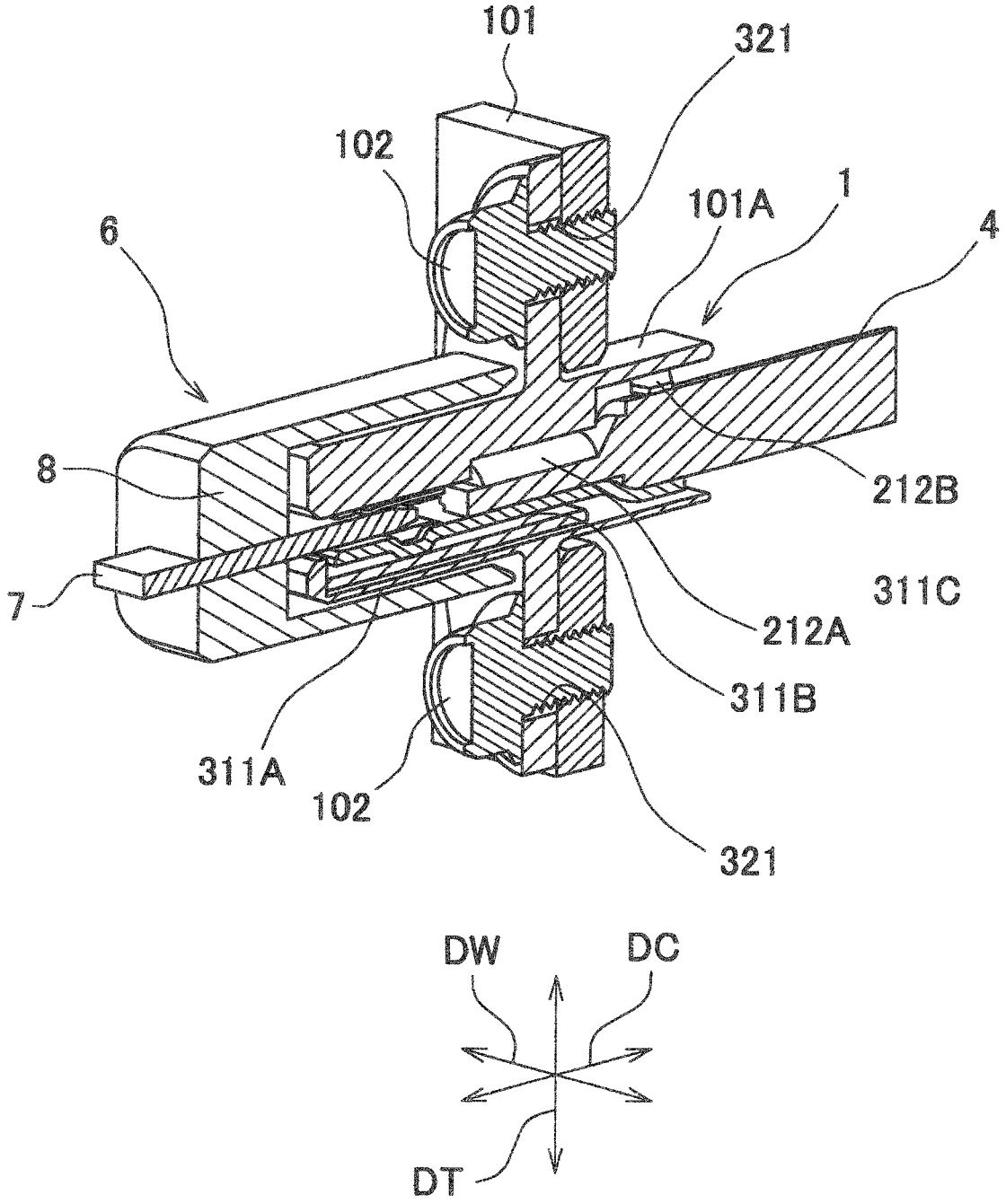
FIG. 3 is a perspective cross-sectional view of the female connector and the male connector in a state in which the male connector is fitted to the female connector appearing in FIG. 1.
Figure 11:
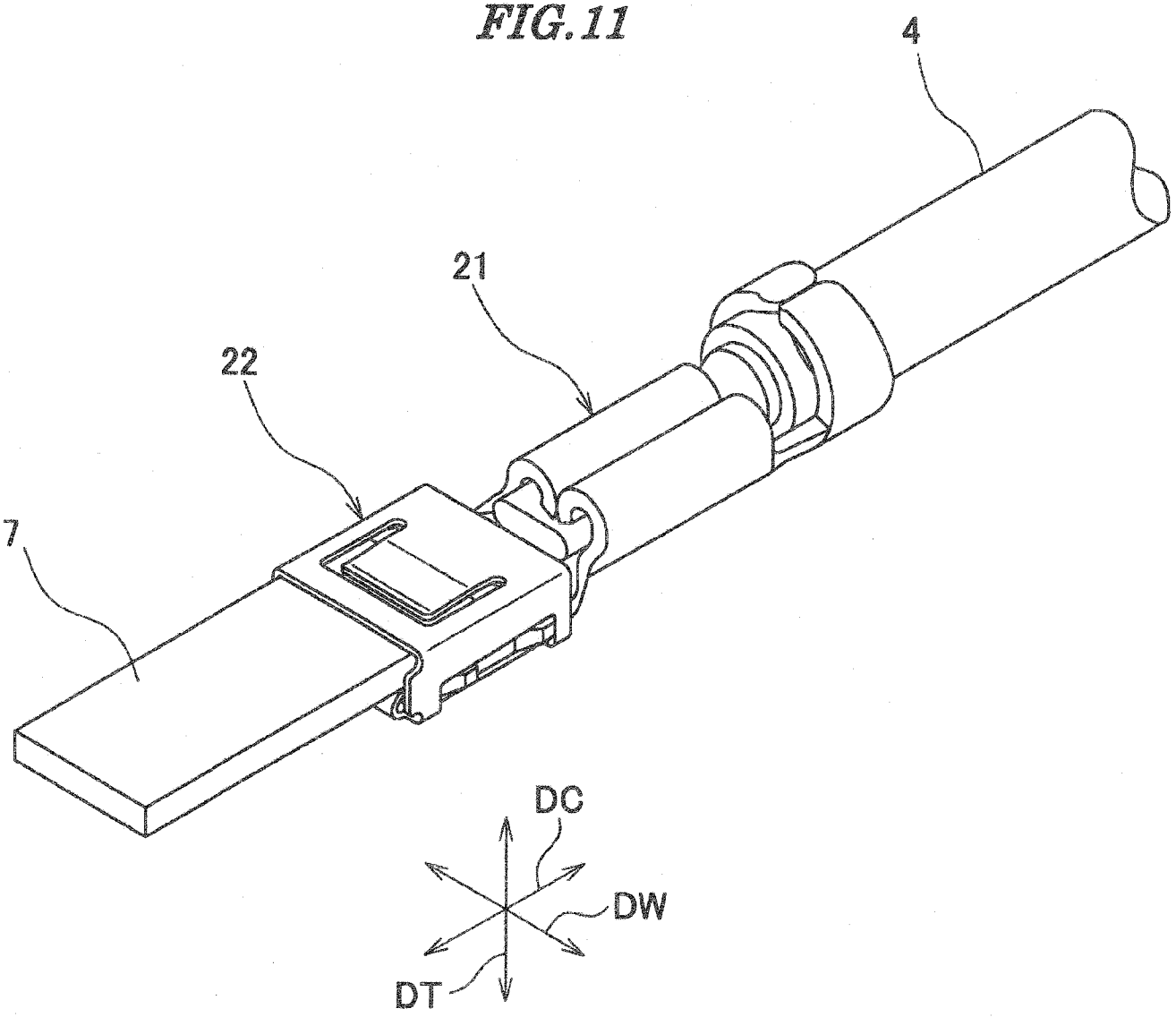
FIG. 11 is a perspective view of the female-side contact shown in FIG. 5 and the male-side contact in a state in which the male-side contact is inserted into the female-side contract.
Figure 12:
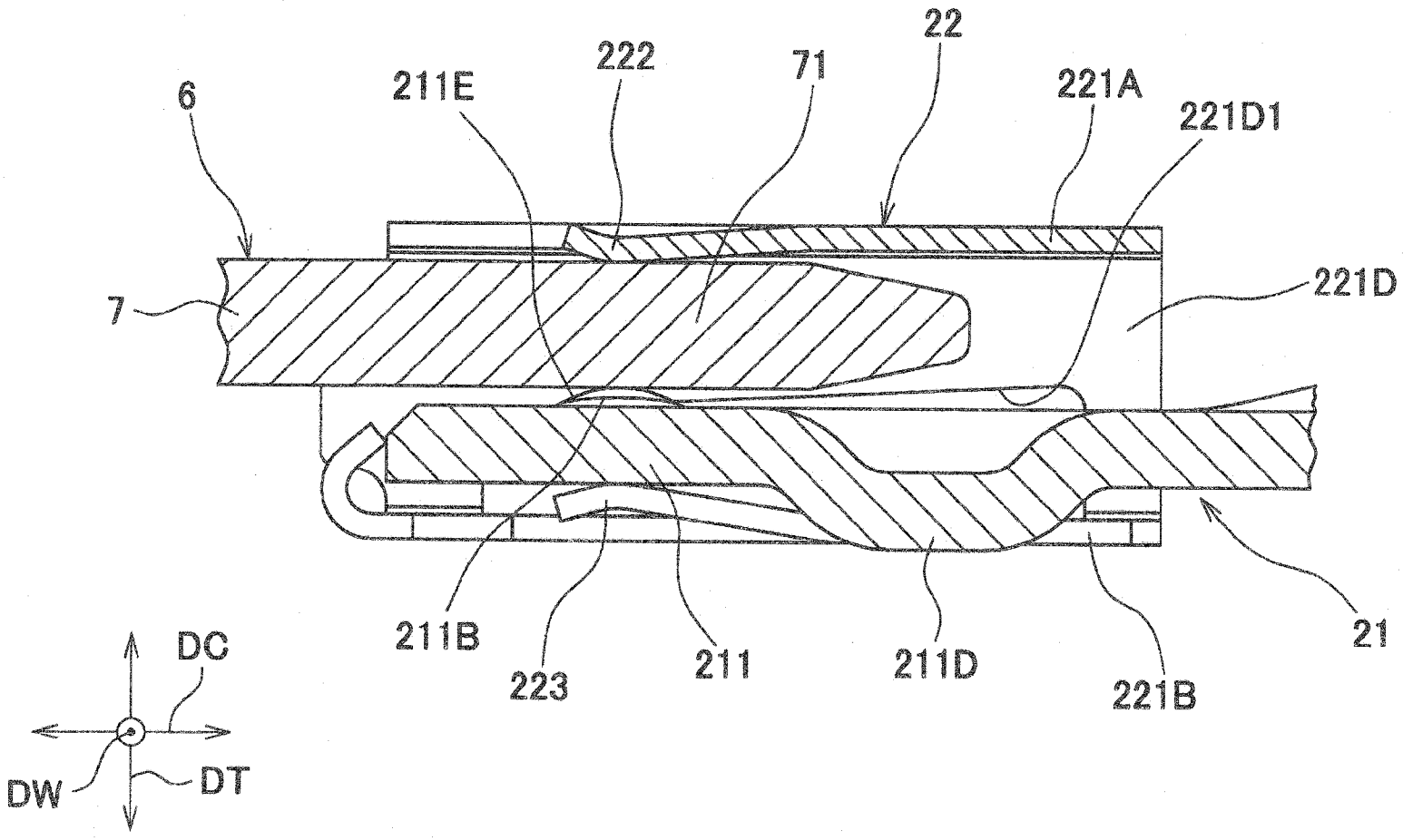
FIG. 12 is an enlarged partial cross-sectional view of the female-side contact and the male-side contact shown in FIG. 11.

To connect the male connector 6 to the female connector 1 fixed to the casing 101, first, as shown in FIGS. 1, 2, and 11, the male connector 6 is disposed in front of the female connector 1, and then, as shown in FIGS. 3, 4, and 12, the male connector 6 is fitted to the female connector 1.

When the male connector 6 is fitted to the female connector 1, as shown in FIG. 12, the contact portion 71 of the male-side contact 7 and the contact portion 211 of the female-side contact 2 are brought into contact with each other by action of the returning forces of the first spring portion 222 and the second spring portions 223 of the supporting member 22. At this time, a lower surface of the contact portion 71 of the male-side contact 7 and the cylindrical surfaces 211E of the contact point portions 211B of the female connector 1 are brought into contact with each other, whereby the female connector 1 and the male connector 6 are electrically connected.

Figure 13:
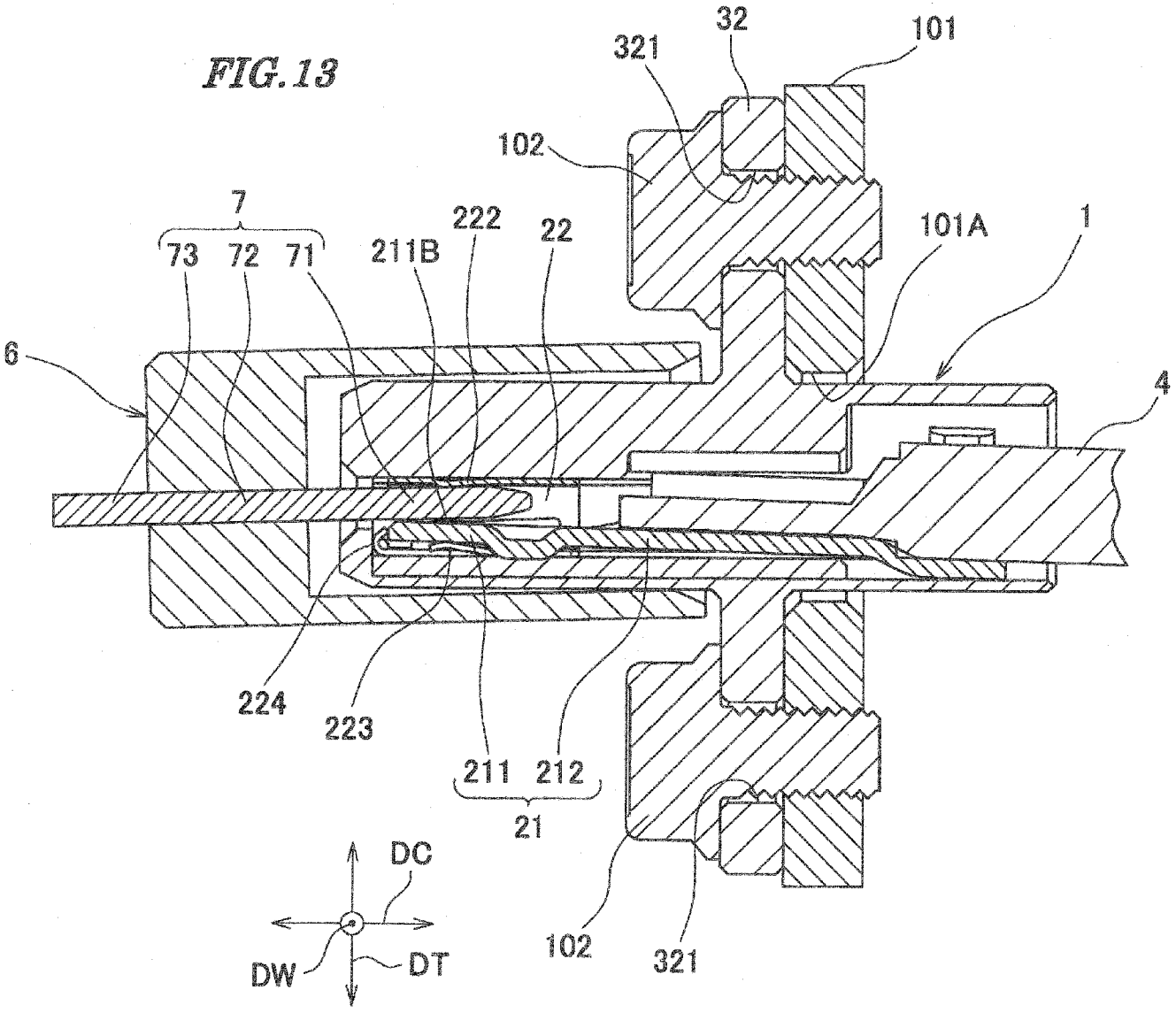
FIG. 13 is a cross-sectional view of the female connector and the male connector in a state in which the male connector is fitted to the female connector.
Figure 14:
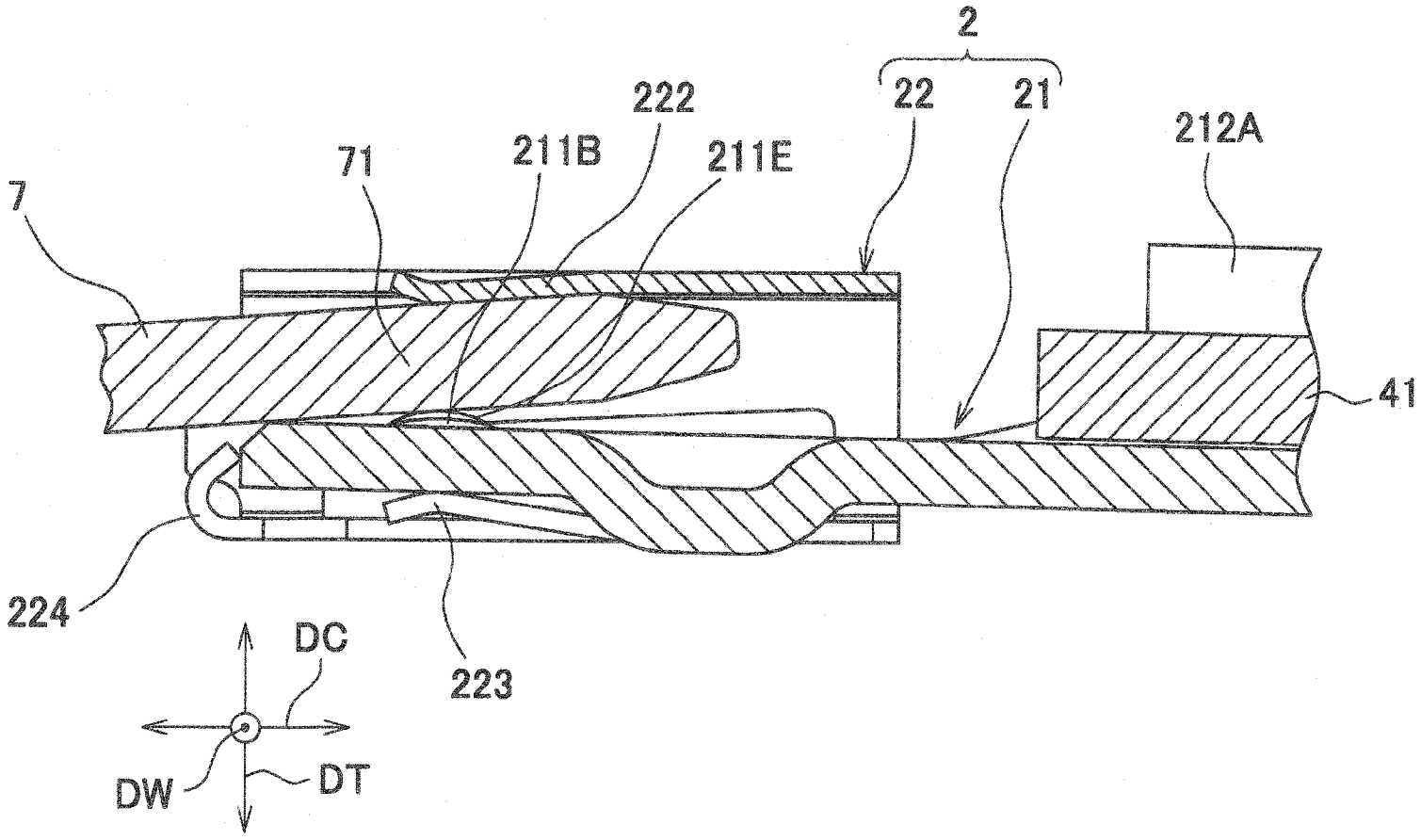
FIG. 14 is an enlarged partial cross-sectional view of the female-side contact, a contact body, and the supporting member, shown in FIG. 13.

As shown in FIG. 13, even when the male-side contact 7 of the male connector 6 is inserted into the supporting member 22 in a state inclined obliquely upward with respect to the direction DC of the central axis of the supporting member 22 e.g. due to a manufacturing error of the male connector 6, or even when the cable 4 is pulled downward, causing the contact body 21 of the female connector 1 to be inclined with respect to the direction DC of the central axis of the supporting member 22, as shown in FIG. 14, a contact state between the lower surface of the contact portion 71 of the male-side contact 7 and the cylindrical surface 211E of each contact point portion 211B of the female-side contact 2 is maintained, and hence a contact area between the lower surface of the contact portion 71 and the contact point portion 211B is unchanged.

Figure 15:
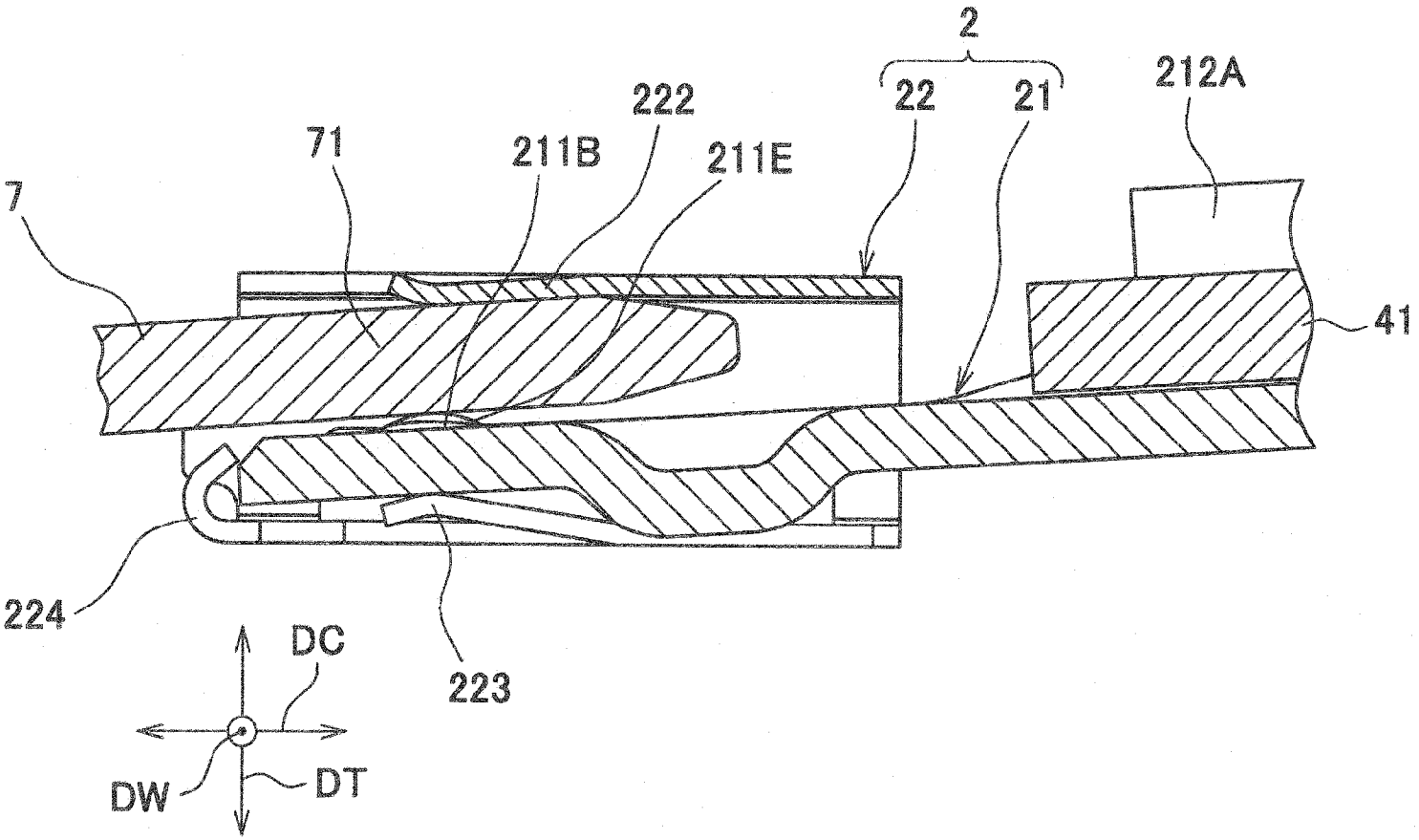
FIG. 15 is an enlarged partial cross-sectional view showing a state in which a cable is pulled upward from a state shown in FIG. 14.

Further, as shown in FIG. 15, when the cable 4 is pulled upward, only the position of contact between the lower surface of the contact portion 71 of the male-side contact 7 and the cylindrical surface 211E of each contact point portion 211B of the female-side contact 2 is changed on the cylindrical surface 211E, and the contact area between the lower surface of the contact portion 71 and the cylindrical surface 211E is unchanged.

Figure 16:
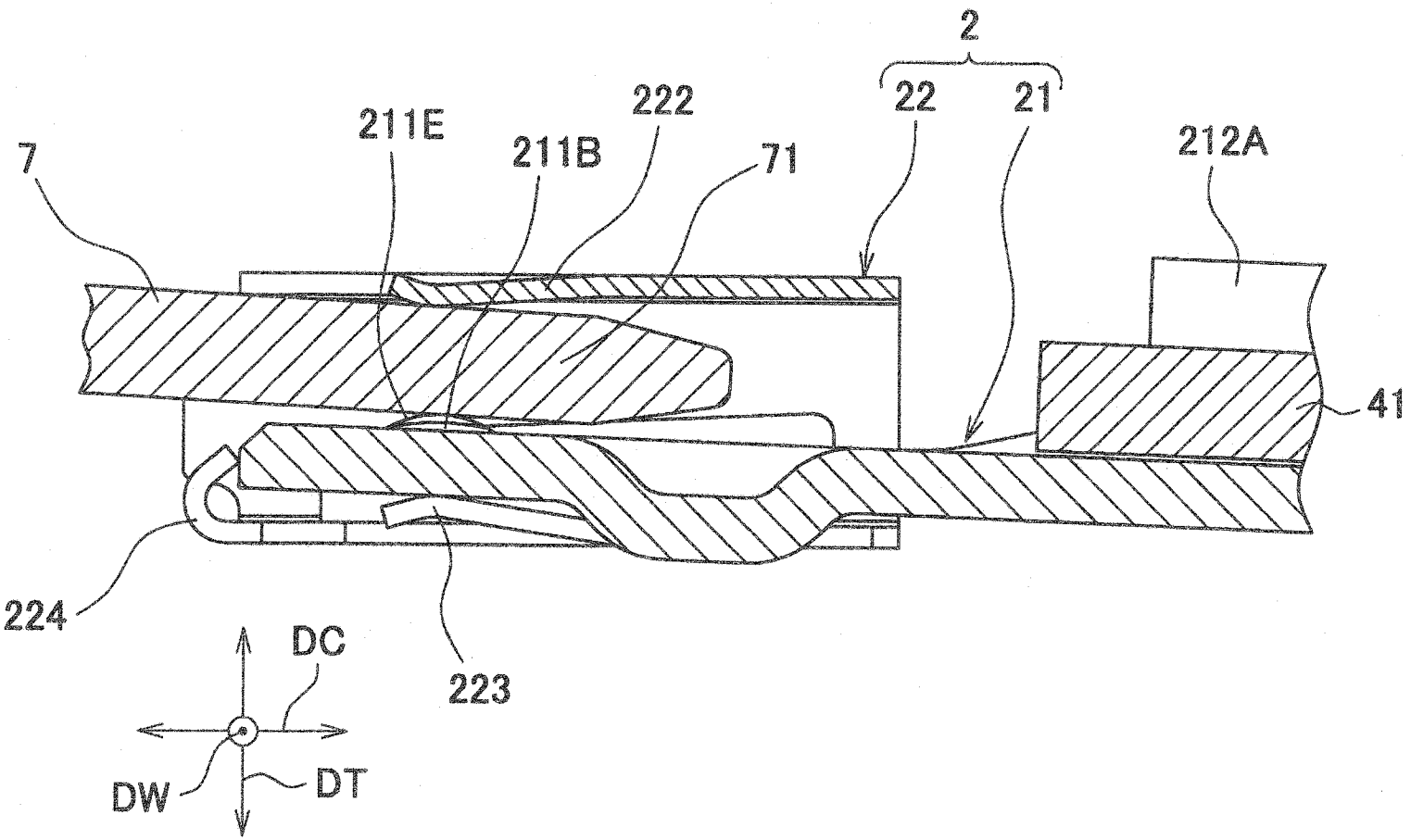
FIG. 16 is an enlarged partial cross-sectional view showing a state in which the male-side contact is inserted into the supporting member slightly downward, and the contact body is inclined slightly upward.

As shown in FIG. 16, even when the male-side contact 7 of the male connector 6 is inserted into the supporting member 22 in a state inclined obliquely downward with respect to the direction DC of the central axis of the supporting member 22, or even when the cable 4 is pulled downward, causing the contact body 21 of the female connector 1 to be inclined, the contact state between the lower surface of the contact portion 71 of the male-side contact 7 and the cylindrical surface 211E of each contact point portion 211B of the female-side contact 2 is maintained, and hence the contact area between the lower surface of the contact portion 71 and the contact point portion 211B is unchanged.

Figure 17:
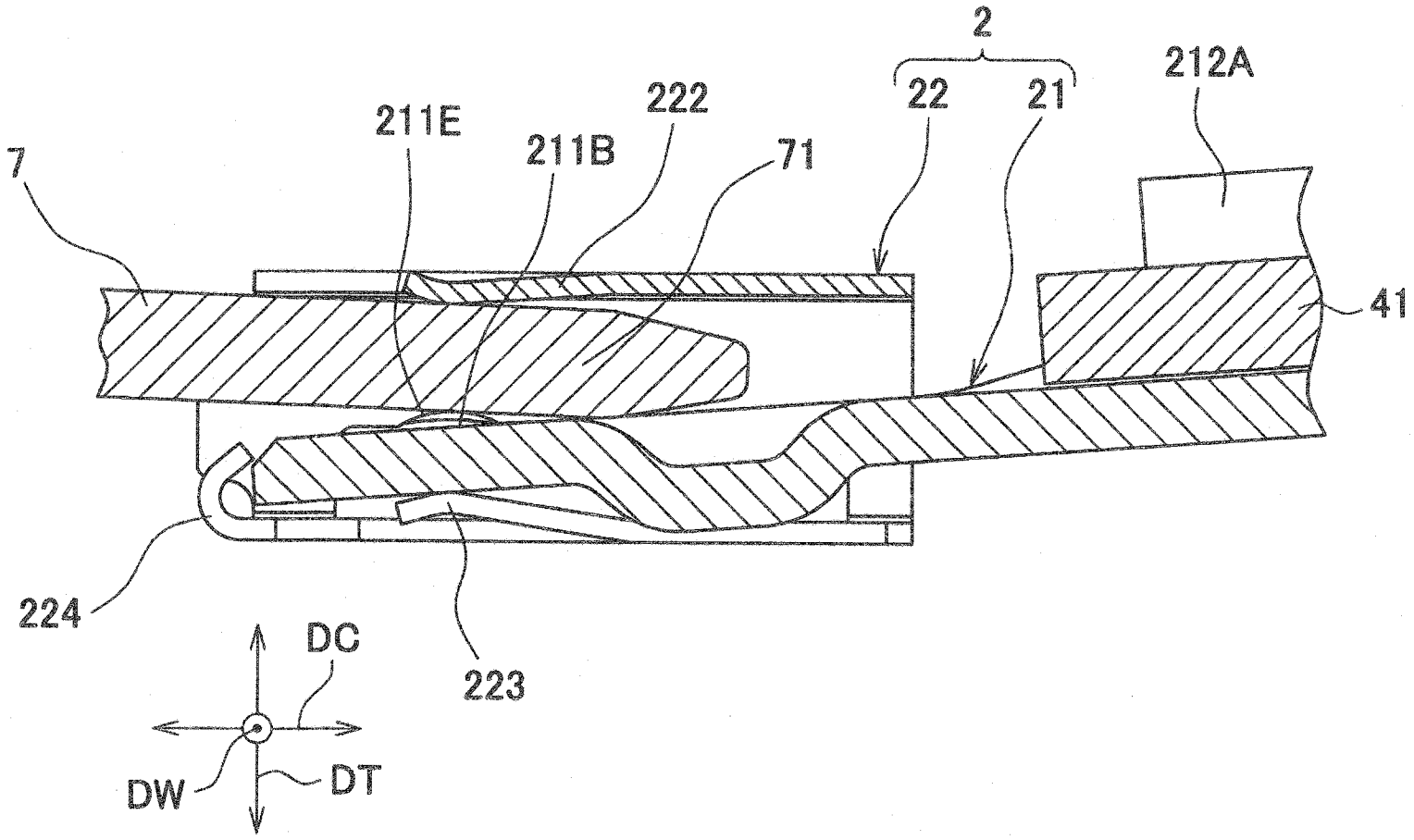
FIG. 17 is an enlarged partial cross-sectional view showing a state in which the cable is pulled upward from the state shown in FIG. 16.
Figure 18:
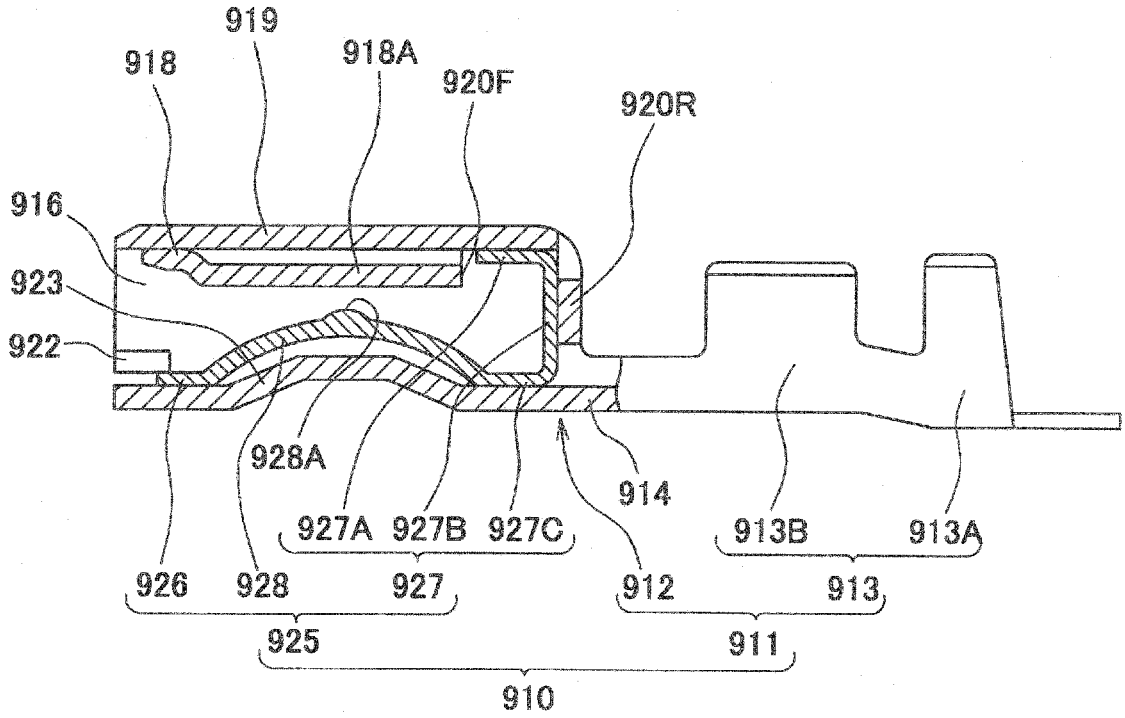
FIG. 18 is a partially cutaway cross-sectional view of a conventional contact.
Figure 19:
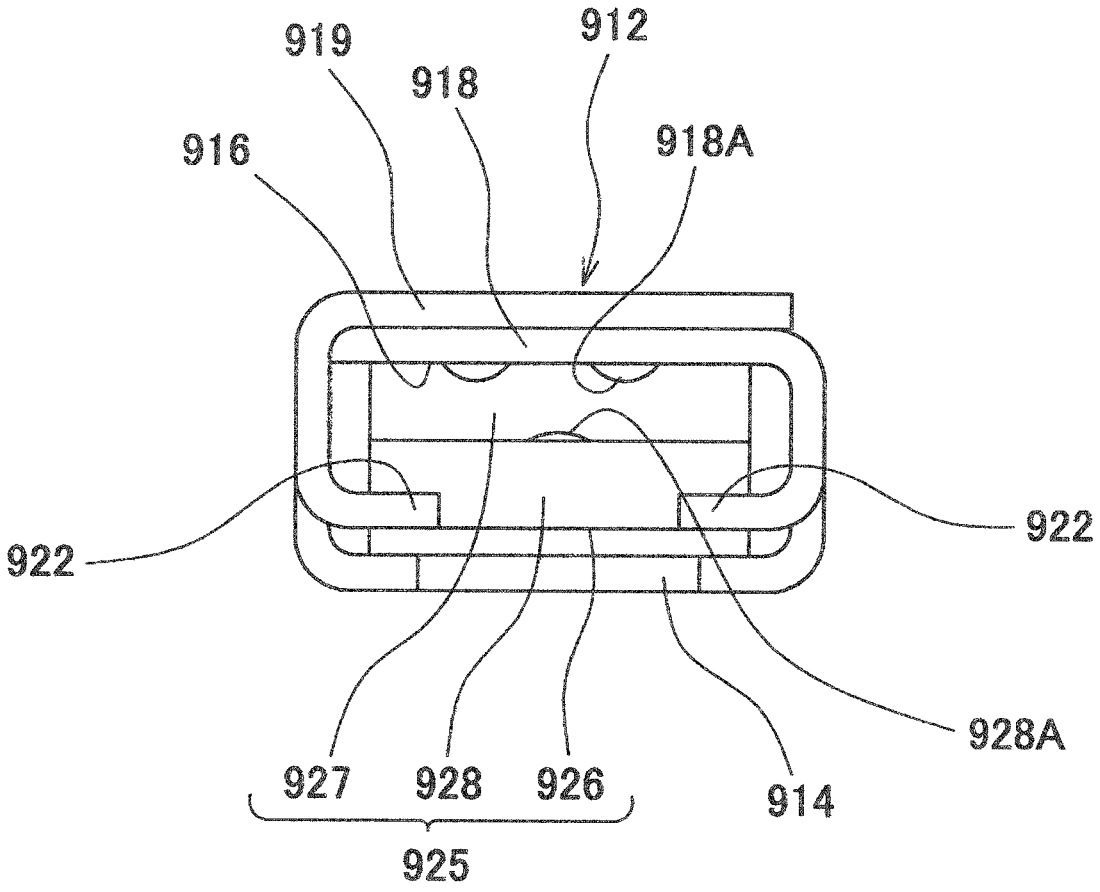
FIG. 19 is a front view of the contact shown in FIG. 18.
Figure 20:
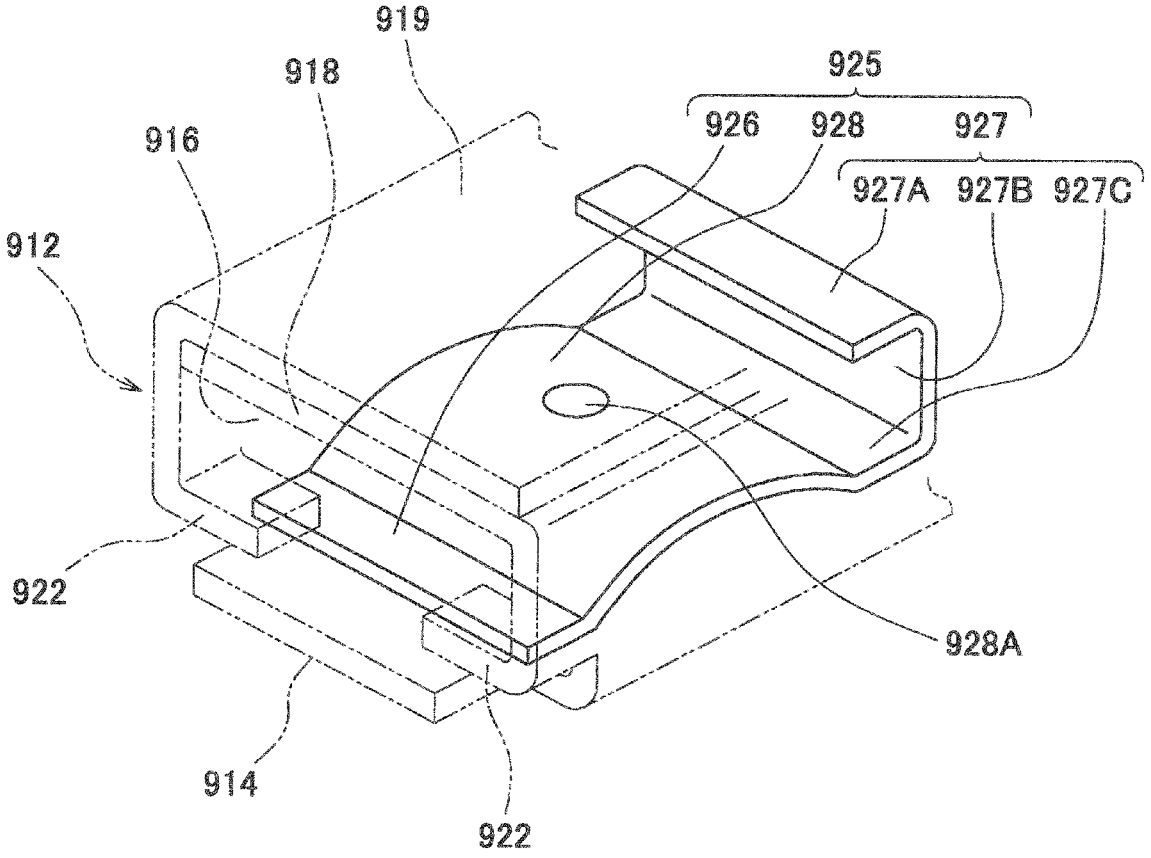
FIG. 20 is a perspective view of an elastic contact body appearing in FIG. 18.

Further, as shown in FIG. 17, when the cable 4 is pulled upward, only the position of contact between the lower surface of the contact portion 71 of the male-side contact 7 and the cylindrical surface 211E of each contact point portion 211B of the female-side contact 2 is changed on the cylindrical surface 211E, and the contact area between the lower surface of the contact portion 71 and the cylindrical surface 211E is unchanged.

According to the present embodiment, even when a misalignment (state of the contact portion body 211A and the contact portion 71 of the male-side contact 7 being not parallel to each other) is caused between the female-side contact 2 and the male-side contact 7 due to a manufacturing error or pulling of the cable 4, the misalignment between the female-side contact 2 and the male-side contact 7 can be accommodated since the contact body 21 of the female-side contact 2 of the female connector 1 is supported by the supporting member 22 in a movable manner, which makes it possible to prevent reduction of the contact reliability between the female-side contact 2 and the male-side contact 7. Further, even when the cable 4 is pulled in a vertical direction, a large bending load is not applied to the contact body 21, and hence the contact body 21 is less likely to be damaged.

Next, a description will be given of a variation of the above-described embodiment.

Although in the above-described embodiment, the contact point portions 211B each having the cylindrical surface 211E are employed as the contact point portions formed on the contact body 21, as a variation of the present embodiment, contact point portions (not shown) each having a spherical surface may be employed in place of the contact point portions 211B each having the cylindrical surface 211E. Note that, in this case, a straight line connecting a center and an apex of the spherical surface is parallel to the spring portion-bending direction DT.

According to this variation, it is possible to obtain the same advantageous effects as provided by the above-described embodiment.

Although in the above-described embodiment, the supporting member 22 includes both the first spring portion 222 and the second spring portions 223, the supporting member 22 may be provided with either the first spring portion 222 or the second spring portions 223.

Further, although in the above-described embodiment, one first spring portion 222 and two second spring portions 223 are provided, each of the first spring portion 222 and the second spring portion 223 may be either single or plural.

Further, although in the above-described embodiment, the supporting member 22 has a square tube shape and includes the upper wall 221A and the lower wall 221B, the shape of the supporting member is not limited to the square tube shape. For example, the supporting member may be formed into a U-shape in cross-section. In this case, the supporting member includes one of the upper wall (wall) 221A and the lower wall (wall) 221B.

Note that in a case where the supporting member 22 accommodated in the contact accommodating chamber 311 of the housing 3 has a U-shape in cross-section, portions where the protrusions 211C are inserted may be either the holes 221C1 and 221D1 or cutouts (not shown).

Further, although in the above-described embodiment, the object to which the female-side contact 2 of the female connector 1 is to be connected is the cable 4, the object to which the female-side contact 2 is to be connected is not limited to the cable 4.

Although in the above-described embodiment, the contact body 21 is larger in thickness than the supporting member 22, the contact body 21 may be equal in thickness to the supporting member 22.

It is further understood by those skilled in the art that the foregoing are the preferred embodiments of the present invention, and that various changes and modification may be made thereto without departing from the spirit and scope thereof.

What is claimed is:

1. A contact comprising:

a contact body including a contact portion that is brought into contact with a mating contact portion of a mating contact; and a supporting member that is a component separate from the contact body, and not only receives therein the mating contact portion, but also supports the contact portion in a movable manner, wherein the supporting member includes a supporting member body that receives therein the mating contact portion and the contact portion, and a spring portion that is provided on the supporting member body, for bringing the mating contact portion inserted into the supporting member body and the contact portion into contact with each other, and wherein the contact portion includes a contact portion body having a flat plate shape, and a contact point portion protruding from the contact portion body into an inside of the supporting member body.

2. The contact according to claim 1, wherein the supporting member includes a stopper portion for restricting movement of the contact portion in a direction parallel to the direction of the central axis of the supporting member.

3. The contact according to claim 1, wherein the contact body is different in thickness from the supporting member, and the contact body is larger in thickness than the supporting member.

4. The contact according to claim 1, wherein the contact body includes a connection portion that is continuous with the contact portion and is connected to an object to be connected.

5. The contact according to claim 4, wherein the object to be connected is a cable.

6. The contact according to claim 1, wherein the contact point portion has a cylindrical surface, and wherein the central axis of the cylindrical surface is orthogonal to a direction of the central axis of the supporting member and a bending direction of the spring portion.

7. The contact according to claim 6, wherein the supporting member includes a stopper portion for restricting movement of the contact portion in a direction parallel to the direction of the central axis of the supporting member.

8. The contact according to claim 6, wherein the contact body is different in thickness from the supporting member, and the contact body is larger in thickness than the supporting member.

9. The contact according to claim 6, wherein the supporting member body has a square tube shape, wherein the supporting member body includes an upper wall and a lower wall which are opposed to each other, and wherein the spring portion is provided on at least one of the upper wall and the lower wall.

10. The contact according to claim 9, wherein the supporting member body includes a pair of side walls which are at right angles to the upper wall and the lower wall, respectively, and are opposed to each other, wherein the pair of side walls each have a hole formed therethrough, and wherein the contact portion includes a plurality of protrusions which are continuous with the contact portion body, and are inserted into the holes and supported by the pair of side walls in a movable manner.

11. The contact according to claim 6, wherein the supporting member body has a U-shape in cross-section, wherein the supporting member body includes a wall opposed to the contact portion body, and wherein the spring portion is provided on the wall.

12. The contact according to claim 11, wherein the supporting member body includes a pair of side walls which are at right angles to the wall, respectively, and are opposed to each other, wherein the pair of side walls each have a hole formed therethrough, and wherein the contact portion includes a plurality of protrusions which are continuous with the contact portion body and are inserted into the holes and supported by the pair of side walls in a movable manner.

13. The contact according to claim 6, wherein the contact body includes a connection portion that is continuous with the contact portion and is connected to an object to be connected.

14. The contact according to claim 13, wherein the object to be connected is a cable.

15. The contact according to claim 1, wherein the contact point portion has a spherical surface, and wherein a straight line connecting a center and an apex of the spherical surface is parallel to the bending direction.

16. The contact according to claim 15, wherein the supporting member body has a square tube shape, wherein the supporting member body includes an upper wall and a lower wall which are opposed to each other, and wherein the spring portion is provided on at least one of the upper wall and the lower wall.

17. The contact according to claim 16, wherein the supporting member body includes a pair of side walls which are at right angles to the upper wall and the lower wall, respectively, and are opposed to each other, wherein the pair of side walls each have a hole formed therethrough, and wherein the contact portion includes a plurality of protrusions which are continuous with the contact portion body, and are inserted into the holes and supported by the pair of side walls in a movable manner.

18. The contact according to claim 15, wherein the supporting member body has a U-shape in cross-section, wherein the supporting member body includes a wall opposed to the contact portion body, and wherein the spring portion is provided on the wall.

19. The contact according to claim 18, wherein the supporting member body includes a pair of side walls which are at right angles to the wall, respectively, and are opposed to each other, wherein the pair of side walls each have a hole formed therethrough, and wherein the contact portion includes a plurality of protrusions which are continuous with the contact portion body and are inserted into the holes and supported by the pair of side walls in a movable manner.

20. A connector comprising:

a contact including:

a contact body including a contact portion that is brought into contact with a mating contact portion of a mating contact, and a supporting member that is a component separate from the contact body, and not only receives therein the mating contact portion, but also supports the contact portion in a movable manner, wherein the supporting member includes a supporting member body that receives therein the mating contact portion and the contact portion, and a spring portion that is provided on the supporting member body, for bringing the mating contact portion inserted into the supporting member body and the contact portion into contact with each other, and wherein the contact portion includes a contact portion body having a flat plate shape, and a contact point portion protruding from the contact portion body into an inside of the supporting member body; and a housing that accommodates the contact, and holds the supporting member.

21. The connector according to claim 20, wherein the housing includes:

a housing body that is inserted into a mounting hole formed in a casing, and a flange portion that is provided on an outer peripheral surface of the housing body, and has bolt insertion holes for use in fixing the housing body to the casing.

22. The connector according to claim 20, wherein the contact point portion has a cylindrical surface, and wherein the central axis of the cylindrical surface is orthogonal to a direction of the central axis of the supporting member and a bending direction of the spring portion.

23. The connector according to claim 22, wherein the housing includes:

a housing body that is inserted into a mounting hole formed in a casing, and a flange portion that is provided on an outer peripheral surface of the housing body, and has bolt insertion holes for use in fixing the housing body to the casing.

* * * * *